US009013374B2

(12) United States Patent
Han

(10) Patent No.: US 9,013,374 B2
(45) Date of Patent: Apr. 21, 2015

(54) PIXEL AND ORGANIC LIGHT EMITTING DISPLAY USING THE SAME

(75) Inventor: Sam-Il Han, Yongin (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 1130 days.

(21) Appl. No.: 12/852,344

(22) Filed: Aug. 6, 2010

(65) Prior Publication Data

US 2011/0090202 A1 Apr. 21, 2011

(30) Foreign Application Priority Data

Oct. 19, 2009 (KR) ..... 10-2009-0099213

(51) Int. Cl.
*G09G 3/30* (2006.01)
*G09G 3/32* (2006.01)

(52) U.S. Cl.
CPC ..... *G09G 3/32* (2013.01); *G09G 3/3233* (2013.01); *G09G 2300/0814* (2013.01); *G09G 2300/0819* (2013.01); *G09G 2300/0842* (2013.01); *G09G 2300/0861* (2013.01)

(58) Field of Classification Search
USPC ..... 345/76–83, 211
See application file for complete search history.

(56) References Cited

U.S. PATENT DOCUMENTS

2007/0200838 A1* 8/2007 Lee et al. ..... 345/204
2007/0296672 A1* 12/2007 Kim et al. ..... 345/92
2008/0224965 A1* 9/2008 Kim ..... 345/76
2009/0174699 A1 7/2009 Fish et al.

FOREIGN PATENT DOCUMENTS

KR 10-2006-0023672 (A) 3/2006
KR 10-2006-0064194 (A) 6/2006
KR 10-2006-0112983 (A) 11/2006
KR 10-0822205 B1 4/2008
KR 10-2008-0050113 A 6/2008
KR 10-2008-0084730 A 9/2008
KR 10-0889675 B1 3/2009

OTHER PUBLICATIONS

Korean Office Action dated Sep. 30, 2011 for Korean Patent Application No. KR 10-2009-0099213 which corresponds to captioned U.S. Appl. No. 12/852,344.

* cited by examiner

*Primary Examiner* — Kathy Wang-Hurst
*Assistant Examiner* — Jose Soto Lopez
(74) *Attorney, Agent, or Firm* — Knobbe, Martens, Olson & Bear, LLP

(57) ABSTRACT

A pixel circuit for an organic light emitting diode display is disclosed. The pixel is configured to provide fast response time and good isolation from data transition coupling.

23 Claims, 7 Drawing Sheets

PIXEL AND ORGANIC LIGHT EMITTING DISPLAY USING THE SAME

CROSS-REFERENCE TO RELATED APPLICATION

This application claims priority to and the benefit of Korean Patent Application No. 10-2009-0099213, filed on Oct. 19, 2009, in the Korean Intellectual Property Office, the entire content of which is incorporated herein by reference.

BACKGROUND

1. Field

The field relates to a pixel and an organic light emitting display using the same, and more particularly, to a pixel suitable for realizing high resolution and high frequency and an organic light emitting display using the same.

2. Description of the Related Technology

Various flat panel displays (FPD) having reduced weight and volume when compared to cathode ray tubes (CRT) are being developed. The FPDs include a liquid crystal display (LCD), a field emission display (FED), a plasma display panel (PDP), and an organic light emitting display.

The organic light emitting display displays an image using organic light emitting diodes (OLED) that generate light by re-combination of electrons and holes.

The organic light emitting display is used in the market for personal digital assistants (PDA), MP3 players and mobile telephones due to various advantages such as excellent color reproducibility and small thickness.

The OLED used for the organic light emitting display includes an anode electrode, a cathode electrode, and a light emitting layer formed between the anode electrode and the cathode electrode. The OLED emits light from the light emitting layer when current flows from the anode electrode to the cathode electrode. The amount of light emitted corresponds to the amount of current.

FIG. 1 is a circuit diagram illustrating a pixel adopted by a some organic light emitting displays. Referring to FIG. 1, the pixel includes an OLED, a first transistor T1, a second transistor T2, a third transistor T3, a fourth transistor T4, a fifth transistor T5, a sixth transistor T6, and a capacitor Cst. Each of the first to sixth transistors T1 to T6 includes a gate electrode, a source electrode, and a drain electrode. The capacitor Cst includes a first electrode and a second electrode.

The source electrode of the first transistor T1 is coupled to a first node A, the drain electrode of the first transistor T1 is coupled to a second node B, and the gate electrode of the first transistor T1 is coupled to a third node C.

The source electrode of the second transistor T2 is coupled to a data line Dm and the drain electrode of the second transistor T2 is coupled to the first node A. The gate electrode of the second transistor T2 is coupled to a first scan line Sn. Therefore, a data signal is transmitted to the first node A by a first scan signal input through the first scan line Sn.

The source electrode of the third transistor T3 is coupled to the second node B, the drain electrode of the third transistor T3 is coupled to the third node C, and the gate electrode of the third transistor T3 is coupled to the first scan line Sn. When the third transistor T3 is turned on by the first scan signal transmitted through the first scan line, the potential of the second node B is equal to the potential of the third node C.

The source electrode of the fourth transistor T4 is coupled to an initialization power source Vinit, the drain electrode of the fourth transistor T4 is coupled to the third node C, and the gate electrode of the fourth transistor T4 is coupled to a second scan line Sn−1. The scan signal transmitted to the second scan line Sn−1 transmits the data signal to the pixel in a previous row.

The source electrode of the fifth transistor T5 is coupled to a first pixel power source line ELVDD, the drain electrode of the fifth transistor T5 is coupled to the first node A, and the gate electrode of the fifth transistor T5 is coupled to an emission control line En. Therefore, the first pixel power source ELVDD is selectively transmitted to the first transistor T1 in accordance with the emission control signal transmitted through the emission control line.

The source electrode of the sixth switching transistor T6 is coupled to the third node C, the drain electrode of the sixth switching transistor T6 is coupled to the OLED, and the gate electrode of the sixth switching transistor T6 is coupled to the emission control line En. Therefore, the current that flows from the source electrode of the first transistor to the drain electrode of the first transistor is selectively transmitted to the OLED in accordance with the emission control signal transmitted through the emission control line En.

The first electrode of the capacitor Cst is coupled to the first pixel power source ELVDD and the second electrode of the capacitor Cst is coupled to the third node C. Therefore, when an initialization signal is transmitted to the third node C by the fourth transistor T4, the third node C maintains the initialization voltage because of the capacitor Cst. Then, when the data signal is transmitted to the first transistor T1 by the second transistor T2 and the third transistor T3, the third node C stores the voltage corresponding to the data signal.

The voltage stored in the third node C is as illustrated in EQUATION 1.

$$\begin{aligned} I_{OLED} &= \frac{\beta}{2}(Vgs - Vth)^2 \\ &= \frac{\beta}{2}(Vdata - ELVDD + Vth - Vth)^2 \\ &= \frac{\beta}{2}(Vdata - ELVDD)^2 \end{aligned} \quad \text{[EQUATION 1]}$$

wherein, $I_{OLED}$ represents the current that flows through the OLED, Vgs represents the voltage applied between the gate electrode of the first transistor T1 and the source electrode of the first transistor T1, ELVDD represents the voltage of the first pixel power source, Vth represents the threshold voltage of the first transistor T1, and Vdata represents the voltage of the data signal.

According to EQUATION 1, the current flows through the OLED from the first transistor to correspond to the voltage of the data signal and the voltage of the first pixel power source ELVDD, thus, the threshold voltage is compensated for.

However, since current flows to correspond to the first pixel power source ELVDD and the voltage of the data signal in the pixel, when a difference in the first pixel power source transmitted to the pixels is generated by voltage reduction in the power distribution, the current does not uniformly flow through the pixels.

In addition, when the organic light emitting display has high resolution and receives a high frequency driving signal, the length of one horizontal time is reduced. For example, when the organic light emitting display is driven by 60 Hz with resolution of FHD (full high-definition), the length of the one horizontal time is 14.8 μs. When the organic light emitting display is driven by 120 Hz with resolution of FHD, the length of the one horizontal time is reduced to 7.4 μs.

When the length of the one horizontal time is reduced, time for compensating for the threshold voltage is reduced so that picture quality deteriorates.

SUMMARY OF CERTAIN INVENTIVE ASPECTS

One aspect is a pixel, including an organic light emitting diode (OLED) receiving pixel current flowing from a first pixel power source to a second pixel power source to emit light. The pixel also includes a first transistor, including a gate coupled to a first node, a first electrode coupled to the first pixel power source, and a second electrode coupled to a second node, where the pixel current flows from the first electrode to the second electrode according to a voltage of the gate. The pixel also includes a second transistor for selectively supplying a data signal to a third node, a third transistor for selectively and electrically coupling the gate of the first transistor to the second electrode of the first transistor, a fourth transistor for selectively supplying a voltage of a second compensation power source to a fourth node, and a fifth transistor for selectively supplying a voltage of a first compensation power source to the third node, a sixth transistor for selectively supplying the pixel current to the OLED, a first capacitor positioned between the second node and the fourth node, and a second capacitor positioned between the third node and the fourth node.

Another aspect is an organic light emitting display, including a pixel unit including a plurality of pixels, a data driver for supplying data signals to the pixels, a power source supply unit for supplying a first pixel power source, a second pixel power source, a first compensation power source, and a second compensation power source to the pixels. The display also includes a scan driver for selectively supplying the data signals, the first pixel power source, the second pixel power source, the first compensation power source, and the second compensation power source to the pixels so that the pixel current corresponding to the data signals flows to the pixels. Each of the pixels include an organic light emitting diode (OLED) receiving pixel current flowing from the first pixel power source to the second pixel power source to emit light, a first transistor, including a gate coupled to a first node, a first electrode coupled to the first pixel power source, and a second electrode coupled to a second node, where the pixel current flows from the first electrode to the second electrode according to a voltage of the gate. The pixel also includes a second transistor for selectively supplying a data signal to a third node, a third transistor for selectively and electrically coupling the gate of the first transistor to the second electrode of the first transistor, a fourth transistor for selectively supplying a voltage of a second compensation power source to a fourth node, a fifth transistor for selectively supplying a voltage of a first compensation power source to the third node, a sixth transistor for selectively supplying the pixel current to the OLED, a first capacitor positioned between the second node and the fourth node, and a second capacitor positioned between the third node and the fourth node.

BRIEF DESCRIPTION OF THE DRAWINGS

The accompanying drawings, together with the specification, illustrate exemplary embodiments, and, together with the description, serve to explain certain inventive principles.

DETAILED DESCRIPTION OF CERTAIN INVENTIVE EMBODIMENTS

Figure 1:
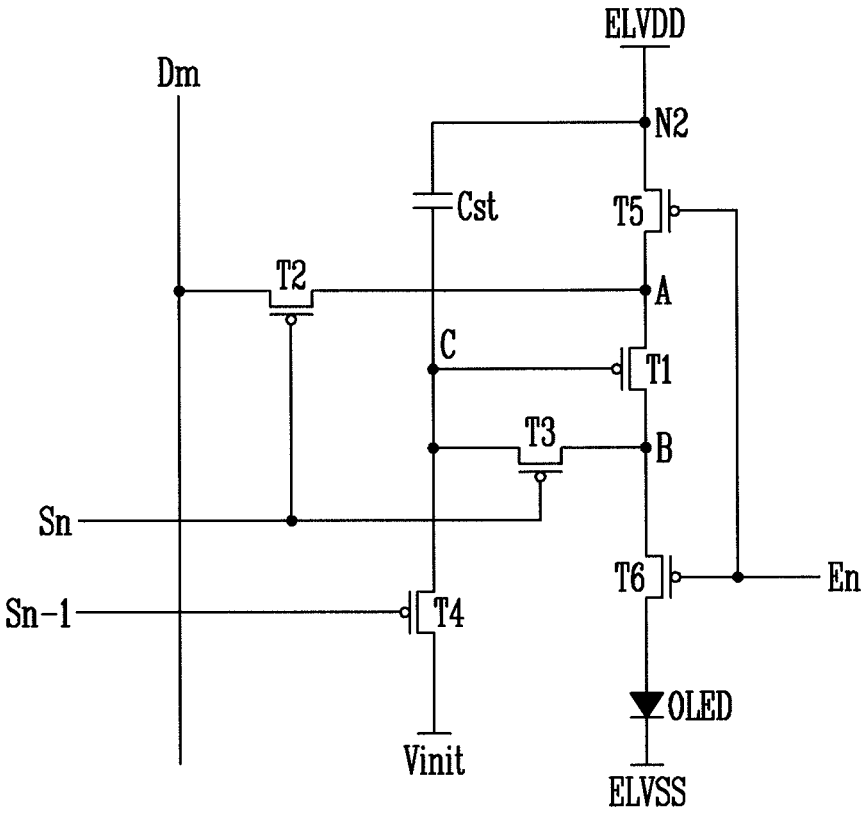
FIG. 1 is a circuit diagram illustrating the pixel adopted by some organic light emitting displays.

Hereinafter, certain exemplary embodiments will be described with reference to the accompanying drawings. When a first element is described as being coupled to a second element, the first element may be not only directly coupled to the second element but may also be indirectly coupled to the second element via a third element. Further, some of the elements that are not essential to the complete understanding of the invention are omitted for clarity. Also, like reference numerals generally refer to like elements throughout.

Figure 2:
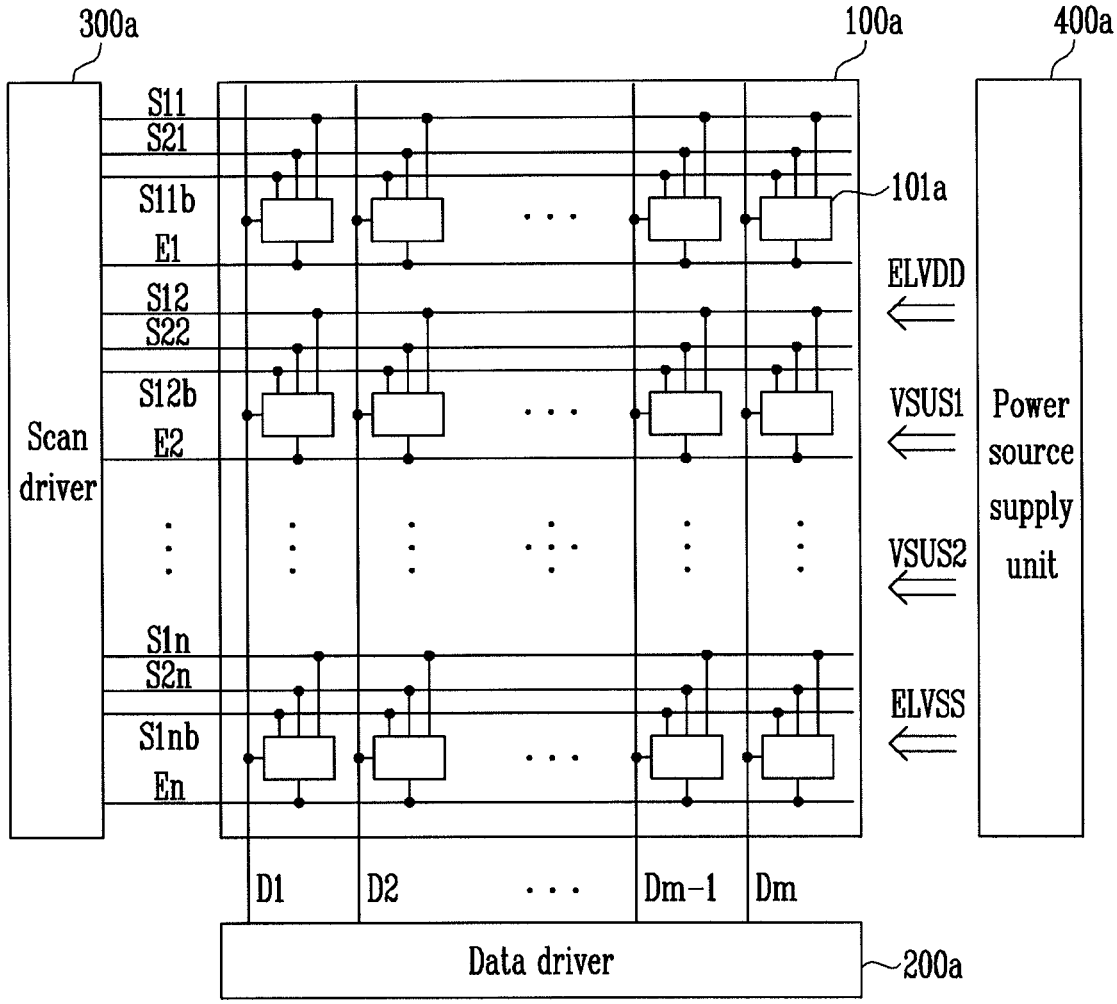
FIG. 2 is a block diagram illustrating an embodiment of an organic light emitting display.

FIG. 2 is a block diagram illustrating an embodiment of an organic light emitting display. Referring to FIG. 2, the organic light emitting display includes a pixel unit 100*a*, a data driver 200*a*, a scan driver 300*a*, and a power source supply unit 400*a*.

The pixel unit 100*a* includes a plurality of pixels 101*a* including m data lines D1, D2, . . . , Dm−1, and Dm, n first scan lines S11, S12, . . . , S1*n*−1, and S1*n*, *n* first sub-scan lines S11*b*, S12*b*, . . . , S1*n*−1b, and S1*nb*, n second scan lines S21, S22, . . . , S2*n*−1, and S2*n*, and n emission control lines E1, E2, . . . , En−1, and En and formed in the regions defined by the m data lines D1, D2, . . . , Dm−1, and Dm, the n first scan lines S11, S12, . . . , S1*n*−1, and S1*n*, the n second scan lines S21, S22, . . . , S2*n*−1, and S2*n*, the n first sub-scan lines S11*b*, S12*b*, . . . , S1*n*−1b, and S1*nb*, and the n emission control lines E1, E2, . . . , En−1, and En. The pixels 101*a* include pixel circuits and organic light emitting diodes (OLED), generate the data signals transmitted from the pixel circuits to the m data lines D1, D2, . . . , Dm−1, and Dm, the scan signals transmitted through the n first scan lines S11, S12, . . . , S1*n*−1, and S1*n*, the n first sub-scan lines S11*b*, S12*b*, . . . , S1*n*−1b, and S1*nb*, and the n second scan lines S21, S22, . . . , S2*n*−1, and S2*n*, and the pixel current that flows through the pixels by sub-scan signals and emission control signals, and controls the flow of the pixel current to the OLEDs. In addition, the pixel receives a first pixel power source ELVDD, a second pixel power source ELVSS, a first compensation power source VSUS1, and a second compensation power source VSUS2 so that the current corresponding to the data signal may flow through the pixel.

The data driver 200*a* coupled to the m data lines D1, D2, . . . , Dm−1, and Dm generates the data signals and sequentially transmits the data signals in a row to the m data lines D1, D2, . . . , Dm−1, and Dm.

The scan driver 300*a* coupled to the n first scan lines S11, S12, . . . , S1*n*−1, and S1*n*, the n first sub-scan lines S11*b*, S12*b*, . . . , S1*n*−1b, and S1*nb*, and the n second scan lines S21, S22, . . . , S2*n*−1, and S2*n* generates the first scan signals, the first sub-scan signals, and the second scan signals and transmits the first scan signals, the first sub-scan signals, and the second scan signals to the n first scan lines S11, S12, . . . , S1*n*−1, and S1*n*, the n first sub-scan lines S11*b*, S12*b*, . . . , S1*n*−1b, and S1*nb*, and the n second scan lines S21, S22, . . . , S2*n*−1, and S2*n*.

In addition, the scan driver 300*a* coupled to n emission control lines E1, E2, . . . , En−1, and En generates the emission control signals and transmits the emission control signals to the n emission control lines E1, E2, . . . , En−1, and En. The emission control signals are illustrated to be generated by the scan driver 300*a*. However, the emission control signals may be generated by an additional driver, the emission control signals may be transmitted to the n emission control lines E1, E2, . . . , En−1, and En.

The power source supply unit 400*a* generates the first pixel power source ELVDD, the second pixel power source ELVSS, the first compensation power source VSUS1, and the second compensation power source VSUS2 and transmits the first pixel power source ELVDD, the second pixel power source ELVSS, the first compensation power source VSUS1, and the second compensation power source VSUS2 to the pixel unit 100*a*. In some embodiments, the first compensation power source VSUS1 has substantially the same voltage as first pixel power source ELVDD. In some embodiments, the second compensation power source VSUS2 has substantially the same voltage as second pixel power source ELVSS.

Figure 3:
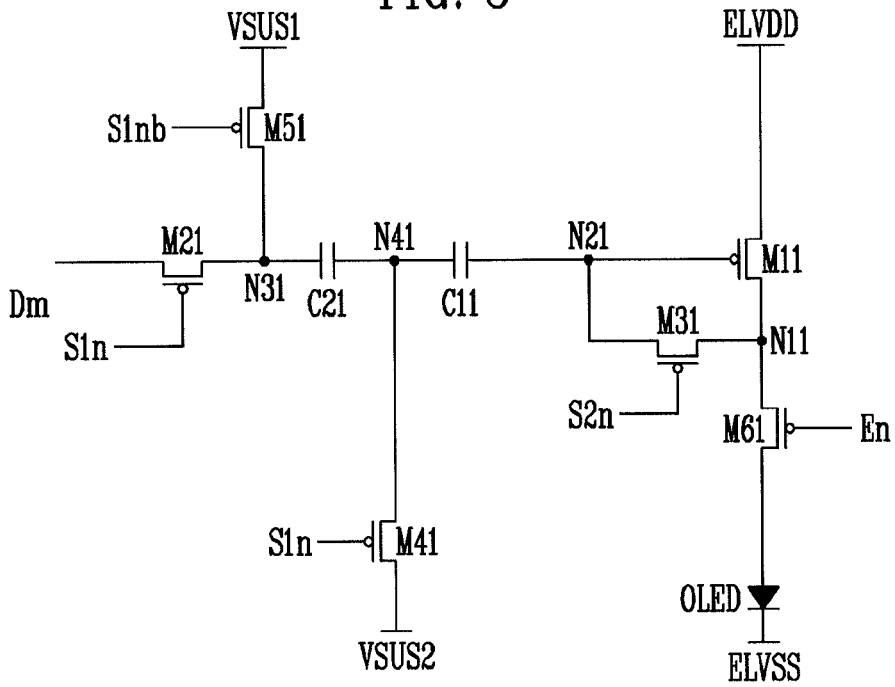
FIG. 3 is a circuit diagram illustrating an embodiment of the pixel adopted by the organic light emitting display of FIG. 2.

FIG. 3 is a circuit diagram illustrating an embodiment of the pixel adopted by the organic light emitting display of FIG. 2. Referring to FIG. 3, the pixel 101*a* includes first to sixth transistors M11 to M61, first and second capacitors C11 and C21, and an organic light emitting diode OLED. The first pixel power source ELVDD and the second pixel power source ELVSS having a lower voltage than the first pixel power source ELVDD are transmitted to the pixel. In addition, the first compensation power source VSUS1 and the second compensation power source VSUS2 are transmitted to the pixel. The pixel is coupled to the data line Dm, the first scan line S1*n*, the second scan line S2*n*, the first sub-scan line S1*nb*, and the emission control line En. In addition, each transistor includes three electrodes of a source, a drain, and a gate. When the source is referred to as a first electrode, the drain may be referred to as a second electrode.

In the first transistor M11, the source is coupled to the first pixel power source ELVDD, the drain is coupled to a first node N11, and the gate is coupled to a second node N21.

In the second transistor M21, the source is coupled to the data line Dm, the drain is coupled to a third node N31, and the gate is coupled to the first scan line S1*n*.

In the third transistor M31, the source is coupled to the first node N11, the drain is coupled to a second node N21, and the gate is coupled to the second scan line S2*n*.

In the fourth transistor M41, the source is coupled to the second compensation power source VSUS2, the drain is coupled to a fourth node N41, and the gate is coupled to the first scan line S1*n*.

In the fifth transistor M51, the source is coupled to the first compensation power source VSUS1, the drain is coupled to the third node N31, and the gate is coupled to the first sub-scan line S1*nb*.

In the sixth transistor M61, the source is coupled to the first node N11, the drain is coupled to the OLED, and the gate is coupled to the emission control line En.

In the first capacitor C11, the first electrode is coupled to the second node N21 and the second electrode is coupled to the fourth node N41.

In the second capacitor C21, the first electrode is coupled to the fourth node N41 and the second electrode is coupled to the third node N31.

In the OLED, an anode is coupled to the sixth transistor M61 and a cathode is coupled to the second pixel power source ELVSS.

Figure 4:
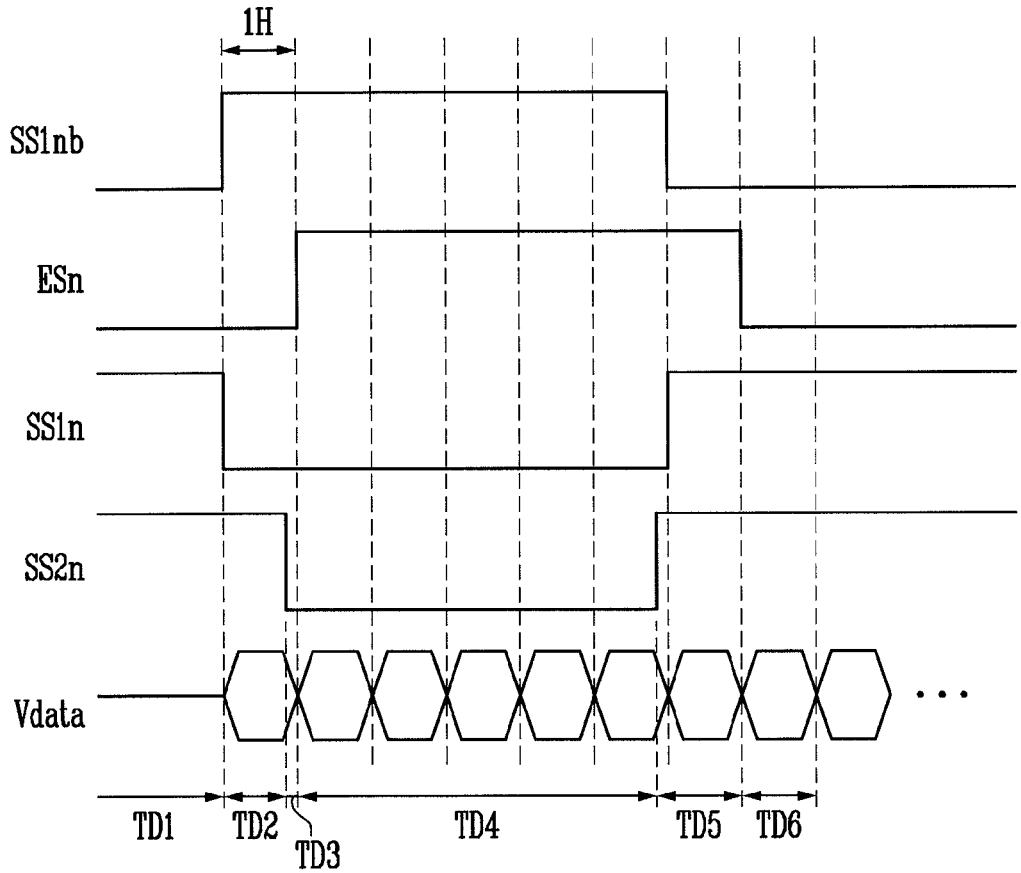
FIG. 4 is a timing diagram illustrating the operation of the pixel of FIG. 3.

FIG. 4 is a timing diagram illustrating the operation of the pixel of FIG. 3. Referring to FIG. 4, the signal input to the pixel 101*a* includes a first scan signal SS1*n*, a first sub-scan signal SS1*nb*, a second scan signal SS2*n*, and an emission control signal ESn.

First, in a first period TD1, the first scan signal SS1*n* is in a high level, the first sub-scan signal SS1*nb* is in a low level, the second scan signal SS2*n* is in a high level, and the emission control signal ESn is in a low level. Therefore, the fifth transistor M51 and the sixth transistor M61 are turned on and the second transistor M21, the third transistor M31, and the fourth transistor M41 are turned off. Then, the first compensation power source VSUS1 is transmitted to the third node N31. The voltage of the first compensation power source VSUS1 is set to correspond to the voltage of the data signal that displays black so that the first compensation power source VSUS1 is transmitted to the third node N31 and, although the voltage of the second node N21 changes, no current flows from the source of the first transistor M11 to the drain of the first transistor M11. Therefore, although the sixth transistor M61 is turned on, no current flows to the OLED.

In a second period TD2, the first scan signal SS1*n* is in a low level, the first sub-scan signal SS1*nb* is in a high level, the second scan signal SS2*n* is in a high level, and the emission control signal ESn is in a low level. Therefore, the second transistor M21, the fourth transistor M41, and the sixth transistor M61 are on and the third transistor M31 and the fifth transistor M51 are off. When the second transistor M21 and the fourth transistor M41 are on, the data signal Vdata is transmitted to the third node N31. The second compensation power source VSUS2 is transmitted to the node N41. The second compensation power source VSUS2 is set to correspond to the voltage of the data signal that displays black. Accordingly, although the sixth transistor M61 is turned on, no current flows to the OLED.

In a third period TD3, the first scan signal SS1*n* is in a low level, the first sub-scan signal SS1*nb* is in a high level, and the emission control signal ESn is in a low level. Accordingly, the level of the second scan signal SS2*n* is changed from a high level to a low level. Therefore, the second transistor M21, the third transistor M31, the fourth transistor M41, and the sixth transistor M61 are turned on and the fifth transistor M51 is turned off. Therefore, the voltage of the data signal Vdata and the voltage of the second compensation power source VSUS2 are continuously maintained in the third node N31 and the fourth node N41. Then, the second pixel power source ELVSS is transmitted to the second node N21 by the third transistor M31. The second node N21 is initialized by the second pixel power source ELVSS. Because the sixth transistor M61 is turned on, current may flow to the OLED. However, since the third period TD3 is maintained for a very short time, the light emitted by the OLED is not sensed.

Then, in a fourth period TD4, the first scan signal SS1*n* and the second scan signal SS2*n* are in a low level, the first sub-scan signal SS1*nb* is in a high level, and the level of the emission control signal is changed to a high level. Since the emission control signal is in a high level, the sixth transistor M61 is off so that the flow of current to the OLED is blocked. In addition, since the second transistor M21 and the fourth transistor M41 are on, the voltage of the data signal Vdata and the voltage of the second compensation power source VSUS2 are maintained in the third node N31 and the fourth node N41, respectively. Accordingly, the first transistor M11 is diode coupled by the third transistor M31 so that the voltage corresponding to EQUATION 2 is transmitted to the gate of the first transistor M11.

$$Vg=ELVDD-Vth \quad \text{[EQUATION 2]}$$

wherein, Vg represents the gate voltage of the first transistor M11, ELVDD represents the voltage of the first pixel power source ELVDD, and Vth represents the threshold voltage of the first transistor M11.

The voltage corresponding to the EQUATION 2 is maintained at the second node N21 by the first capacitor C11. In addition, the duration of the fourth period TD4 may vary. In FIG. 4, the duration of the fourth period TD4 is illustrated as about 5H. However, if the threshold voltage may be sufficiently compensated for, the time may be shorter than 5H.

In a fifth period TD5, the level of the second scan signal SS2*n* is changed to a high level, the first scan signal SS1*n* is in a high level and the first sub-scan signal SS1*nb* is in a low level. In addition, the emission control signal ESn is in a high level. Because the voltage of the third node N31 is changed from the voltage of the data signal Vdata to the voltage of the first compensation power source VSUS1 and the fourth transistor M41 is turned off, the voltage of the fourth node N41 and the voltage of the second node N21 change by a difference between the voltage of the data signal and the voltage of the first compensation power source VSUS1.

Therefore, the voltage of the second node N21 corresponds to EQUATION 3.

$$Vg=ELVDD-Vth-(Vdata-VSUS1) \quad \text{[EQUATION 3]}$$

wherein, Vg represents the gate voltage of the first transistor M11, ELVDD represents the voltage of the first pixel power source ELVDD, Vth represents the threshold voltage of the first transistor M11, Vdata represents the voltage of the data signal Vdata, and VSUS1 represents the voltage of the first compensation power source VSUS1.

In a sixth period TD6, the first scan signal SS1*n* and the second scan signal SS2*n* are in a high level, and the first sub-scan signal SS1*nb* and the emission control signal ESn are in a high level. At this time, the sixth transistor M61 is turned on so that the current corresponding to the voltage transmitted to the gate of the first transistor M11 flows to the OLED. In addition, since the first compensation power source VSUS1 is transmitted to the third node N31, the voltage of the second node N21 that is the voltage of the gate of the first transistor M11 formed in the fifth period TD5 does not change.

Therefore, the current that flows to the OLED is expressed by the following EQUATION 4.

$$Ids=\beta(Vgs-Vth)^2=\beta(ELVDD-(ELVDD-Vth+VSUS1-Vdata)-Vth)=\beta(Vdata-VSUS1)^2 \quad \text{[EQUATION 4]}$$

wherein, Ids represents the current that flows through the OLED, β represents a constant, and Vgs represents a voltage between the source of the first transistor M11 and the gate of the first transistor M11.

Therefore, the current that flows through the OLED corresponds to the voltage of the first compensation power source VSUS1 and the voltage of the data signal Vdata. That is, reduction in the threshold voltage of the first transistor M11 and the voltage of the first pixel power source ELVDD are compensated for.

In addition, the gate voltage of the first transistor M11 does not change by the voltage of the first compensation power source VSUS1 while the OLED emits light so that, although the voltage of the data signal Vdata that flows through the data line Dm changes, the voltage of the gate of the first transistor M11 is not affected. Therefore, cross-talk in accordance with a change in the voltage of the data signal Vdata that flows through the data line Dm may be prevented.

Figure 5:
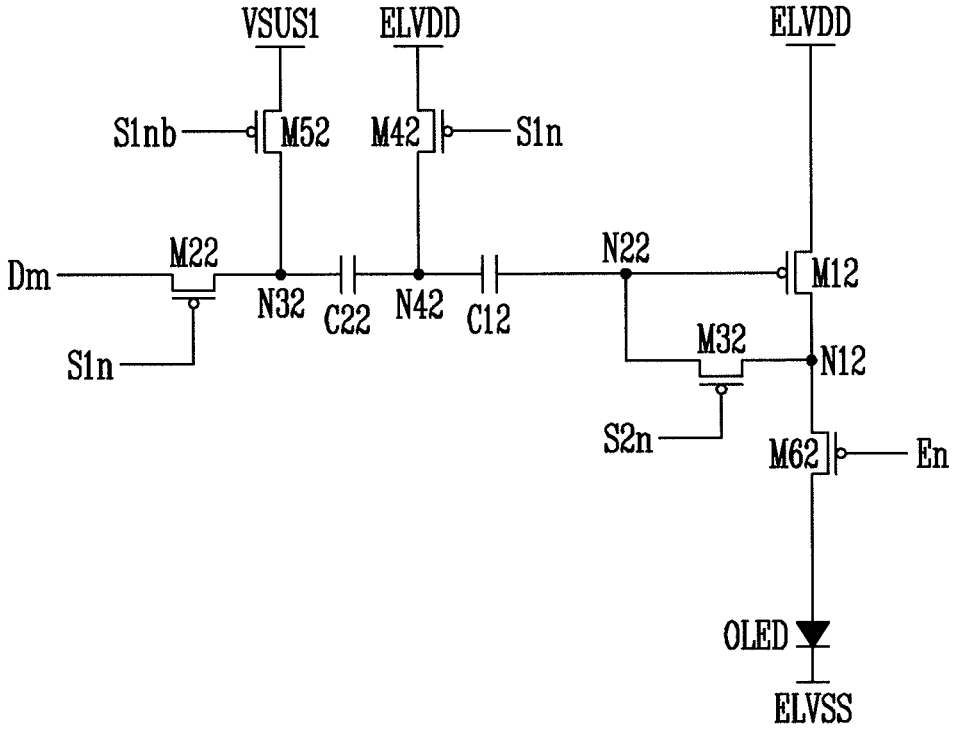
FIG. 5 is a circuit diagram illustrating an embodiment of the pixel adopted by the organic light emitting display of FIG. 2.

FIG. 5 is a circuit diagram illustrating an embodiment of the pixel adopted by the organic light emitting display of FIG. 2. Referring to FIG. 5, the pixel 101*a* includes first to sixth transistors M12 to M62, first and second capacitors C12 and C22, and an OLED. The first pixel power source ELVDD and the second pixel power source ELVSS having a lower voltage than the first pixel power source ELVDD are transmitted to the pixel. In addition, the first compensation power source VSUS1 is transmitted to the pixel. The pixel is coupled to the data line Dm, the first scan line S1*n*, the second scan line S2*n*, the first sub-scan line S1*nb*, and the emission control line En.

In the first transistor M12, the source is coupled to the first pixel power source ELVDD, the drain is coupled to a first node N12, and the gate is coupled to a second node N22.

In the second transistor M22, the source is coupled to the data line Dm, the drain is coupled to a third node N32, and the gate is coupled to the first scan line S1*n*.

In the third transistor M32, the source is coupled to the first node N12, the drain is coupled to a second node N22, and the gate is coupled to the second scan line S2*n*.

In the fourth transistor M42, the source is coupled to the first pixel power source ELVDD, the drain is coupled to a fourth node N42, and the gate is coupled to the first scan line S1*n*.

In the fifth transistor M52, the source is coupled to the first compensation power source VSUS1, the drain is coupled to the third node N32, and the gate is coupled to the first sub-scan line S1*nb*.

In the sixth transistor M62, the source is coupled to the first node N12, the drain is coupled to the OLED, and the gate is coupled to the emission control line En.

In the first capacitor C12, the first electrode is coupled to the second node N22 and the second electrode is coupled to the fourth node N42.

In the second capacitor C22, the first electrode is coupled to the fourth node N42 and the second electrode is coupled to the third node N32.

In the OLED, an anode is coupled to the sixth transistor M62 and a cathode is coupled to the second pixel power source ELVSS.

The pixel having the above structure is driven by the signals illustrated in FIG. 4. Unlike the pixel illustrated in FIG. 3, not the second compensation power source VSUS2 but the first pixel power source ELVDD is used.

Figure 6:
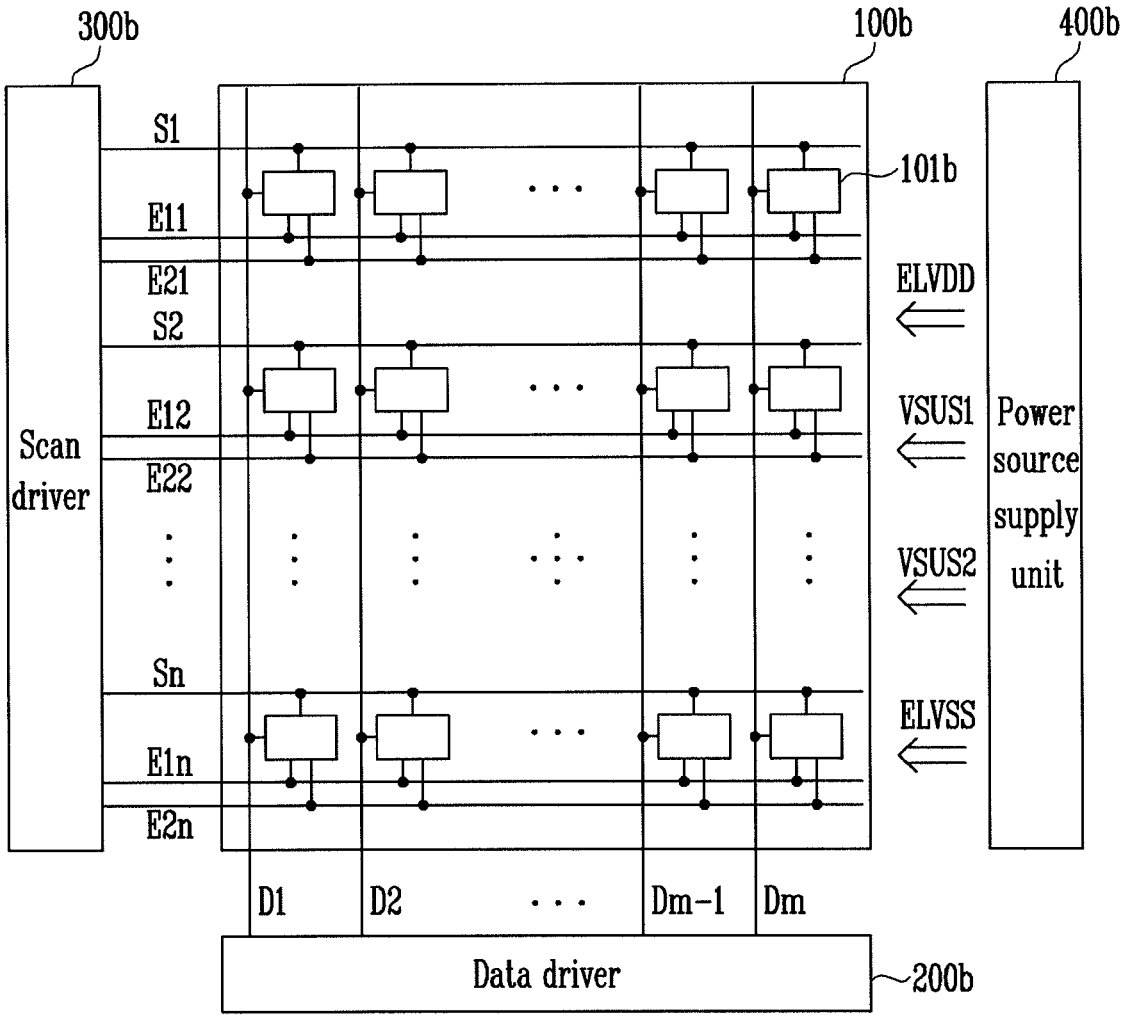
FIG. 6 is a block diagram illustrating an embodiment of the organic light emitting display.

FIG. 6 is a block diagram illustrating an embodiment of the organic light emitting display. Referring to FIG. 6, the organic light emitting display includes a pixel unit 100*b*, a data driver 200*b*, a scan driver 300*b*, and a power source supply unit 400*b*.

The pixel unit 100*b* includes a plurality of pixels 101*b* including m data lines D1, D2, . . . , Dm−1, and Dm, n first scan lines S11, S12, . . . , S1*n*−1, and S1*n*, *n* first emission control lines E11, E12, . . . , E1*n*−1, and E1*n*, and n second emission control lines E21, E22, . . . , E2*n*−1, and E2*n* and formed in the regions defined by the m data lines D1, D2, . . . , Dm−1, and Dm, the n first scan lines S11, S12, . . . , S1*n*−1, and S1*n*, the n first emission control lines E11, E12, . . . , E1*n*−1, and E1*n*, and the n second emission control lines E21, E22, . . . , E2*n*−1, and E2*n*. The pixels 101*b* include pixel circuits and organic light emitting diodes (OLED), generate the data signals transmitted from the pixel circuits to the m data lines D1, D2, . . . , Dm−1, and Dm, the scan signals transmitted through the n first scan lines S11, S12, . . . , S1*n*−1, and S1*n*, the n first emission control lines E11, E12, . . . , E1*n*−1, and E1*n*, and the n second emission control lines E21, E22, . . . , E2*n*−1, and E2*n*, and the pixel current that flows through the pixels to correspond to the data signals by the first emission control signal and the second emission control signal, and controls the flow of the pixel current to the OLEDs. In addition, the pixel receives a first pixel power source ELVDD, a second pixel power source ELVSS, a first compensation power source VSUS1, and a second compensation power source VSUS2 so that the current corresponding to the data signal may flow through the pixel.

The data driver 200*b* coupled to the m data lines D1, D2, . . . , Dm−1, and Dm generates the data signals and sequentially transmits the data signals in a row to the m data lines D1, D2, . . . , Dm−1, and Dm.

The scan driver 300*b* coupled to the n first scan lines S11, S12, . . . , S1*n*−1, and S1*n*, the n first emission control lines E11, E12, . . . , E1*n*−1, and E1*n*, and the n second emission control lines E21, E22, . . . , E2*n*−1, and E2*n* generates the first scan signals, the first emission control signals, and the second emission control signals and transmits the first scan signals, the first emission control signals, and the second emission control signals to the n first scan lines S11, S12, . . . , S1*n*−1, and S1*n*, the n first emission control lines E11, E12, . . . , E1*n*−1, and E1*n*, and the n second emission control lines E21, E22, . . . , E2*n*−1, and E2*n*.

The emission control signals are illustrated as being generated by the scan driver 300*b*. However, an additional driver may generate the emission control signals for transmission to the n emission control lines E1, E2, . . . , En−1, and En.

The power source supply unit 400*b* generates the first pixel power source ELVDD, the second pixel power source ELVSS, the first compensation power source VSUS1, and the second compensation power source VSUS2 and transmits the first pixel power source ELVDD, the second pixel power source ELVSS, the first compensation power source VSUS1, and the second compensation power source VSUS2, if necessary, to the pixel unit 100*b*.

Figure 7:
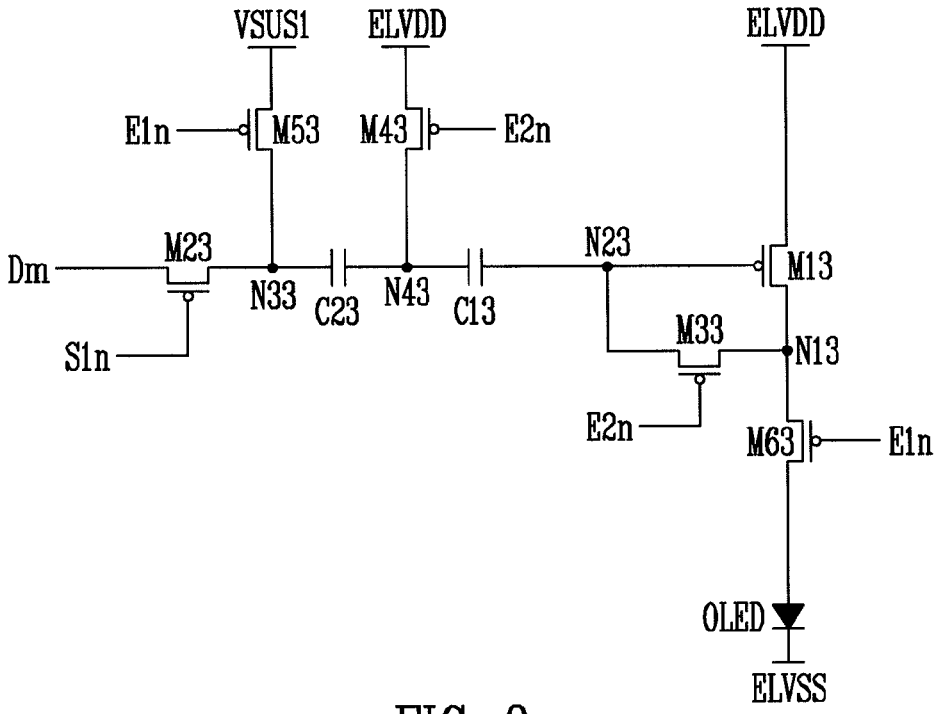
FIG. 7 is a circuit diagram illustrating an embodiment of the pixel adopted by the organic light emitting display of FIG. 6.

FIG. 7 is a circuit diagram illustrating an embodiment of the pixel adopted by the organic light emitting display of FIG. 6. Referring to FIG. 7, the pixel 101*b* includes first to sixth transistors M13 to M63, first and second capacitors C13 and C23, and an OLED. The first pixel power source ELVDD and the second pixel power source ELVSS having a lower voltage than the first pixel power source ELVDD are transmitted to the pixel. In addition, the first compensation power source VSUS1 is transmitted to the pixel. The data line Dm, the first scan line S1*n*, the first emission control line E1*n*, and the second emission control line E2*n* are transmitted to the pixel. In addition, each transistor includes three electrodes of a source, a drain, and a gate. When the source is referred to as a first electrode, the drain may be referred to as a second electrode.

In the first transistor M13, the source is coupled to the first pixel power source ELVDD, the drain is coupled to a first node N13, and the gate is coupled to a second node N23.

In the second transistor M23, the source is coupled to the data line Dm, the drain is coupled to a third node N33, and the gate is coupled to the first scan line S1*n*.

In the third transistor M33, the source is coupled to the first node N13, the drain is coupled to a second node N23, and the gate is coupled to the second emission control line E2*n*.

In the fourth transistor M43, the source is coupled to the first pixel power source ELVDD, the drain is coupled to a fourth node N44, and the gate is coupled to the second emission control line E2*n*.

In the fifth transistor M53, the source is coupled to the first compensation power source VSUS1, the drain is coupled to the third node N33, and the gate is coupled to the first emission control line E1*n*.

In the sixth transistor M63, the source is coupled to the first node N13, the drain is coupled to the OLED, and the gate is coupled to the first emission control line E1*n*.

In the first capacitor C13, the first electrode is coupled to the second node N23 and the second electrode is coupled to the fourth node N43.

In the second capacitor C23, the first electrode is coupled to the fourth node N43 and the second electrode is coupled to the third node N33.

In the OLED, an anode is coupled to the sixth transistor M63 and a cathode is coupled to the second pixel power source ELVSS.

Figure 8:
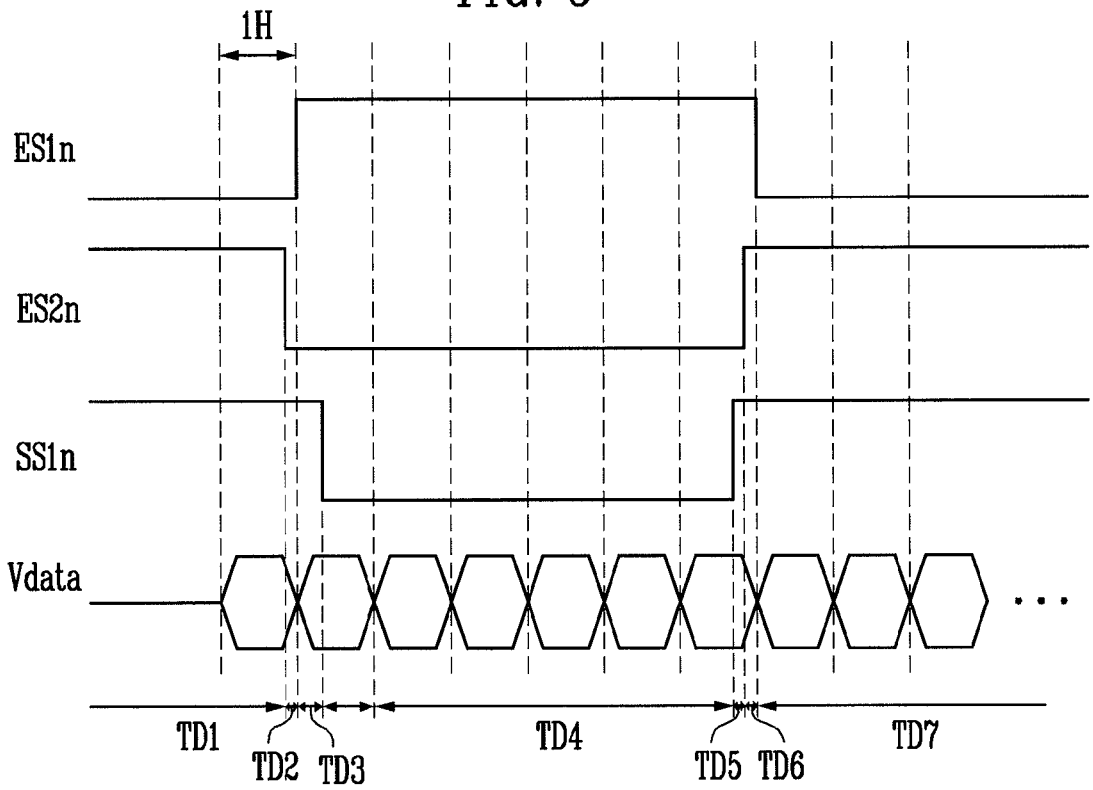
FIG. 8 is a timing diagram illustrating the operation of the pixel of FIG. 7.

FIG. 8 is a timing diagram illustrating the operation of the pixel of FIG. 7. Referring to FIG. 8, the signal input to the pixel 101*b* includes the first scan signal SS1*n*, the first emission control signal ES1*n*, and the second emission control signal ES2*n*.

During a first period TD1, the first scan signal SS1*n* and the second emission control signal ES2*n* are in a high level and the first emission control signal ES1*n* is in a low level. Therefore, the fifth transistor M53 and the sixth transistor M63 are on and the second transistor M23, the third transistor M33, and the fourth transistor M43 are off. The first compensation power source VSUS1 is transmitted to the third node N33. The voltage of the first compensation power source VSUS1 is set to correspond to the voltage of the data signal that displays black. Although the voltage of the second node N23 that is the gate of the first transistor M13 is changed by the first compensation power source VSUS1, the voltage corresponding to at least the first compensation power source VSUS1 is applied to the second node N23 so that no current flows from the source of the first transistor M13 to the drain of the first transistor M13. Therefore, although the sixth transistor M63 is on, no current flows to the OLED.

In a second period TD2, the first scan signal SS1*n* is in a high level and the first emission control signal ES1*n* and the second emission control signal ES2*n* are in a low level. Therefore, the second transistor M21 is off and the third transistor M33, the fourth transistor M43, the fifth transistor M53, and the sixth transistor M63 are on. Since the third transistor M33 and the sixth transistor M63 are on, the second pixel power source ELVSS is transmitted to the second node N23. Because the fourth transistor M43 and the fifth transistor M53 are on, the first compensation power source VSUS1 and the first pixel power source ELVDD are transmitted to the third node N33 and the fourth node N43, respectively.

During a third period TD3, the first scan signal SS1*n* and the first emission control signal ES1*n* are in a high level and the second emission control signal ES2*n* is in a low level. At this time, the second transistor M23, the fifth transistor M53, and the sixth transistor M63 are off and the third transistor M33 and the fourth transistor M43 are on. Since the fourth transistor M43 is on, the first pixel power source ELVDD is transmitted to the fourth node N43, and the voltage of the second node N23 does not change. However, because the sixth transistor M63 is turned off, no current flows to the OLED.

During a fourth period TD4, the first scan signal SS1*n* and the second emission control signal ES2*n* are in a low level and the first emission control signal ES1*n* is in a high level. Since the first emission control signal ES1*n* is in a high level, the sixth transistor M63 is turned off so that the flow of current to the OLED is blocked. In addition, since the second transistor M23 is on, the data signal Vdata is supplied to the third node N33. In addition, since the fourth transistor M43 is on, the first pixel power source ELVDD is transmitted to the fourth node N43. Since the third transistor M33 is turned on, the first transistor M13 is diode coupled so that the voltage corresponding to the EQUATION 2 is transmitted to the gate of the first transistor M13. The second node N23 is coupled to the gate of the first transistor M13 so that the voltage corresponding to the EQUATION 2 is maintained by the first capacitor C13. In addition, the length of the fourth period TD4 may vary. In FIG. 8, the length of the fourth period TD4 is illustrated as 6H. However, if the threshold voltage may be sufficiently compensated for, the time may be shorter than 6H.

Then, in a fifth period TD5, the level of the first scan signal SS1*n* is changed to a high level. Because the first scan signal SS1*n* is in a high level, the second transistor M23 is turned off so that the data signal Vdata is not transmitted to the third node N33. However, the voltage of the second node N23 corresponding to the EQUATION 2 is continuously maintained.

Then, in a sixth period TD6, the first scan signal SS1*n*, the first emission control signal ES1*n*, and the second emission control signal ES2*n* are in a high level.

During a seventh period TD7, the first scan signal SS1*n* and the second emission control signal ES2*n* are in a high level and the first emission control signal ES1*n* is in a low level. Therefore, the voltage of the third node N33 is transited from the voltage of the data signal Vdata to the voltage of the first compensation power source VSUS1. At this time, since the fourth transistor M43 is turned off, the voltage of the fourth node N43 and the voltage of the second node N23 change by a difference between the voltage of the data signal and the voltage of the first compensation power source VSUS1.

Therefore, the voltage of the second node N23 corresponds to the EQUATION 3.

Therefore, the current that flows to the OLED is expressed by the EQUATION 4.

Therefore, the current that flows through the OLED corresponds to the voltage of the first compensation power source VSUS1 and the voltage of the data signal Vdata. That is, the threshold voltage of the first transistor M13 and the voltage of the first pixel power source ELVDD is compensated for.

In addition, the gate voltage of the first transistor M13 is not changed by the voltage of the first compensation power source VSUS1 while the OLED emits light so that, although the voltage of the data signal Vdata that flows to the data line Dm changes, the gate voltage of the first transistor M13 is not affected. Therefore, cross-talk in accordance with a change in the voltage of the data signal Vdata that flows through the data line Dm may be prevented.

Figure 9:
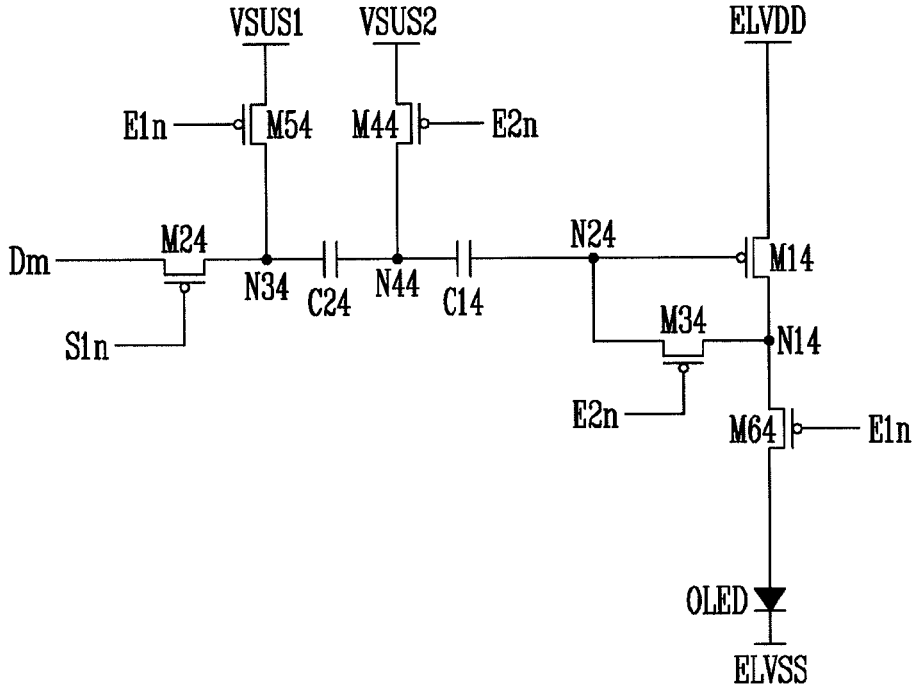
FIG. 9 is a circuit diagram illustrating an embodiment of the pixel adopted by the organic light emitting display of FIG. 6.

FIG. 9 is a circuit diagram illustrating an embodiment of the pixel adopted by the organic light emitting display of FIG. 6. Referring to FIG. 9, the pixel 101*b* includes first to sixth transistors M14 to M64, first and second capacitors C14 and C24, and an OLED. The first pixel power source ELVDD and the second pixel power source ELVSS having a lower voltage than the first pixel power source ELVDD are transmitted to the pixel. In addition, the first compensation power source VSUS1 and the second compensation power source VSUS2 are transmitted to the pixel. The pixel is coupled to the data line Dm, the first scan line S1*n*, the first emission control line E1*n*, and the second emission control line E2*n*.

In the first transistor M14, the source is coupled to the first pixel power source ELVDD, the drain is coupled to a first node N14, and the gate is coupled to a second node N24.

In the second transistor M24, the source is coupled to the data line Dm, the drain is coupled to a third node N34, and the gate is coupled to the first scan line S1*n*.

In the third transistor M34, the source is coupled to the first node N14, the drain is coupled to the second node N24, and the gate is coupled to the first emission control line E1*n*.

In the fourth transistor M44, the source is coupled to the second compensation power source VSUS2, the drain is coupled to the fourth node N44, and the gate is coupled to the second emission control line E2*n*.

In the fifth transistor M54, the source is coupled to the first compensation power source VSUS1, the drain is coupled to the third node N34, and the gate is coupled to the first emission control line E1*n*.

In the sixth transistor M64, the source is coupled to the first node N14, the drain is coupled to the OLED, and the gate is coupled to the first emission control line E1*n*.

In the first capacitor C14, the first electrode is coupled to the second node N24 and the second electrode is coupled to the fourth node N44.

In the second capacitor C24, the first electrode is coupled to the fourth node N44 and the second electrode is coupled to the third node N34.

In the OLED, an anode is coupled to the sixth transistor M64 and a cathode is coupled to the second pixel power source ELVSS.

The pixel having the above structure is driven by the signals illustrated in FIG. 8. Unlike the pixel illustrated in FIG. 7, the second compensation power source VSUS2 is used for the fourth transistor M44, and not the first compensation power source ELVDD.

Figure 10:
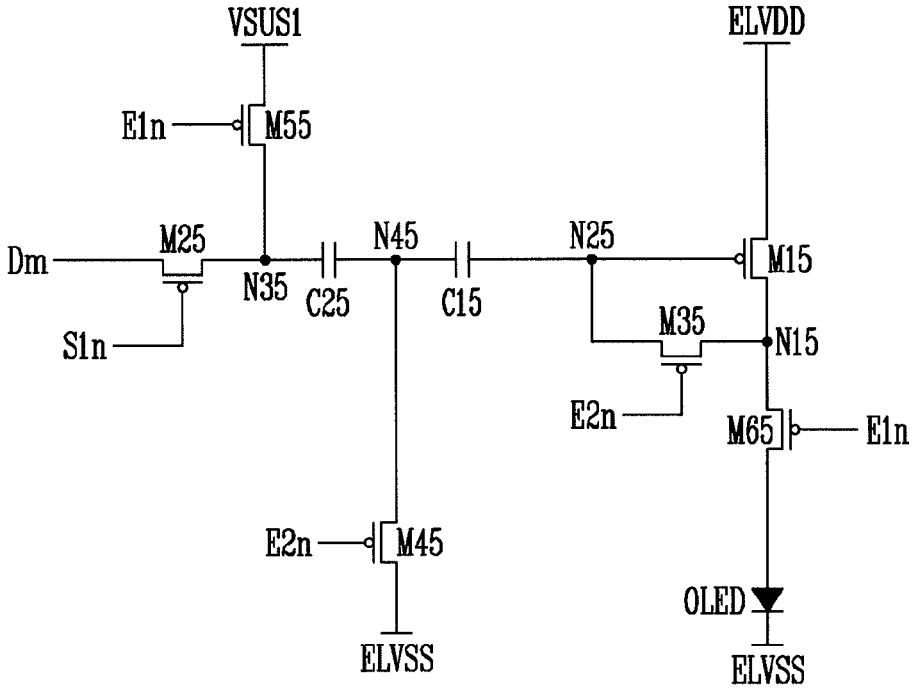
FIG. 10 is a circuit diagram illustrating an embodiment of the pixel adopted by the organic light emitting display of FIG. 6.

FIG. 10 is a circuit diagram illustrating an embodiment of the pixel adopted by the organic light emitting display of FIG. 6. Referring to FIG. 10, the pixel 101*b* includes first to sixth transistors M15 to M65, first and second capacitors C15 and C25, and an OLED. The first pixel power source ELVDD and the second pixel power source ELVSS having a lower voltage than the first pixel power source ELVDD are transmitted to the pixel. In addition, the first compensation power source VSUS1 is transmitted to the pixel. The pixel is coupled to the data line Dm, the first scan line S1*n*, the first emission control line E1*n*, and the second emission control line E2*n*.

In the first transistor M15, the source is coupled to the first pixel power source ELVDD, the drain is coupled to a first node N15, and the gate is coupled to a second node N25.

In the second transistor M25, the source is coupled to the data line Dm, the drain is coupled to a third node N35, and the gate is coupled to the first scan line S1*n*.

In the third transistor M35, the source is coupled to the first node N15, the drain is coupled to the second node N25, and the gate is coupled to the second scan line S2*n*.

In the fourth transistor M45, the source is coupled to the second pixel power source ELVSS, the drain is coupled to the fourth node N45, and the gate is coupled to the second emission control line E2*n*.

In the fifth transistor M55, the source is coupled to the first compensation power source VSUS1, the drain is coupled to the third node N35, and the gate is coupled to the first emission control line E1*n*.

In the sixth transistor M65, the source is coupled to the first node N15, the drain is coupled to the OLED, and the gate is coupled to the first emission control line E1*n*.

In the first capacitor C15, the first electrode is coupled to the second node N25 and the second electrode is coupled to the fourth node N45.

In the second capacitor C25, the first electrode is coupled to the fourth node N45 and the second electrode is coupled to the third node N35.

In the OLED, an anode is coupled to the sixth transistor M65 and a cathode is coupled to the second pixel power source ELVSS.

The pixel having the above structure is driven by the signals illustrated in FIG. 8. Unlike the pixel illustrated in FIG. 7, the second pixel power source ELVSS is used for the fourth transistor M45, and not the first pixel power source ELVDD.

While the present invention has been described in connection with certain exemplary embodiments, it is to be understood that the invention is not limited to the disclosed embodiments, but, on the contrary, is intended to cover various modifications and equivalent arrangements.

What is claimed is:

1. A pixel, comprising:

an organic light emitting diode (OLED) receiving pixel current flowing from a first pixel power source to a second pixel power source to emit light;

a first transistor, comprising:

a gate coupled to a first node;

a first electrode coupled to the first pixel power source; and a second electrode coupled to a second node, wherein the pixel current flows from the first electrode to the second electrode according to a voltage of the gate;

a second transistor for selectively supplying a data signal to a third node;

a third transistor for selectively and electrically coupling the gate of the first transistor to the second electrode of the first transistor;

a fourth transistor for selectively supplying a voltage of a second compensation power source to a fourth node;

a fifth transistor for selectively supplying a voltage of a first compensation power source to the third node;

a sixth transistor for selectively supplying the pixel current to the OLED;

a first capacitor positioned between and configured to directly connect to the second node and the fourth node; and a second capacitor positioned between the third node and the fourth node, wherein the fourth node is between the first and second capacitor.

2. The pixel as claimed in claim 1, wherein the voltage of the first compensation power source is a voltage of the data signal for displaying black.

3. The pixel as claimed in claim 1, wherein the voltage of the first compensation power source is substantially equal to the voltage of the first pixel power source.

4. The pixel as claimed in claim 1, wherein the voltage of the second compensation power source is substantially equal to the voltage of the second pixel power source.

5. The pixel as claimed in claim 1, wherein turning on and off the second transistor and the fourth transistor is determined by a first scan signal, wherein turning on and off the third transistor is determined by a second scan signal, wherein turning on and off the fifth transistor is determined by a first sub-scan signal, and wherein turning on and off of the sixth transistor is determined by an emission control signal.

6. The pixel as claimed in claim 1, wherein turning on and off the second transistor is determined by the first scan signal, wherein turning on and off the third transistor and the fourth transistor is determined by a second emission control signal, and wherein turning on and off the fifth transistor and the sixth transistor is determined by a first emission control signal.

7. The pixel as claimed in claim 5, wherein, after the first scan signal becomes a turn-on signal, the second scan signal becomes a turn-on signal and the emission control signal becomes a turn-off signal, and wherein, after the second scan signal becomes a turn-off signal, the first scan signal becomes a turn-off signal and the emission control signal becomes a turn-on signal.

8. The pixel as claimed in claim 6, wherein the first scan signal has a turn-on period in a period where the first emission control signal is turned off, and wherein the first emission control signal becomes a turn-off signal after the second emission control signal becomes a turn-on signal, and becomes a turn-on signal after the second emission control signal becomes a turn-off signal.

9. The pixel as claimed in claim 5, wherein pixel driving periods comprise:

a first period in which the first sub-scan signal and the emission control signal are in a low level and the first scan signal and the second scan signal are in a high level;

a second period in which the first scan signal and the emission control signal are in a low level and the first sub-scan signal and the second scan signal are in a high level;

a third period in which the first scan signal, the second scan signal, and the emission control signal are in a low level, and the first sub-scan signal is in a high level;

a fourth period in which the first scan signal and the second scan signal are in a low level and the first sub-scan signal and the emission control signal are in a high level;

a fifth period in which the emission control signal is in a high level, the second scan signal is in a high level, the first scan signal is in a high level, and the first sub-scan signal is in a low level; and a sixth period in which the first scan signal and the second scan signal are in a high level and the first sub-scan signal and the emission control signal are in a low level.

10. The pixel as claimed in claim 6, wherein pixel driving periods comprise:

a first period in which the second emission control signal and the first scan signal are in a high level and the first emission control signal is in a low level;

a second period in which the second emission control signal and the first emission control signal are in a low level and the first scan signal is in a high level;

a third period in which the first emission control signal and the first scan signal are in a high level and the second emission control signal is in a low level;

a fourth period in which the first emission control signal is in a high level and the second emission control signal and the first scan signal is in a low level;

a fifth period in which the first emission control signal and the first scan signal are in a high level and the second emission control signal is in a low level;

a sixth period in which the first emission control signal, the second emission control signal, and the first scan signal are in a high level; and a seventh period in which the first emission control signal is in a low level and the second emission control signal and the first scan signal are in a high level.

11. The pixel as claimed in claim 9, wherein the length of the fourth period varies.

12. The pixel as claimed in claim 10, wherein the length of the fourth period varies.

13. An organic light emitting display, comprising:

a pixel unit including a plurality of pixels;

a data driver for supplying data signals to the pixels;

a power source supply unit for supplying a first pixel power source, a second pixel power source, a first compensation power source, and a second compensation power source to the pixels; and a scan driver for selectively supplying the data signals, the first pixel power source, the second pixel power source, the first compensation power source, and the second compensation power source to the pixels so that the pixel current corresponding to the data signals flows to the pixels, wherein each of the pixels comprise:

an organic light emitting diode (OLED) receiving pixel current flowing from the first pixel power source to the second pixel power source to emit light;

a first transistor, comprising:

a gate coupled to a first node;

a first electrode coupled to the first pixel power source; and a second electrode coupled to a second node, wherein the pixel current flows from the first electrode to the second electrode according to a voltage of the gate;

a second transistor for selectively supplying a data signal to a third node;

a third transistor for selectively and electrically coupling the gate of the first transistor to the second electrode of the first transistor;

a fourth transistor for selectively supplying a voltage of a second compensation power source to a fourth node;

a fifth transistor for selectively supplying a voltage of a first compensation power source to the third node;

a sixth transistor for selectively supplying the pixel current to the OLED;

a first capacitor positioned between and configured to directly connect to the second node and the fourth node; and a second capacitor positioned between the third node and the fourth node, wherein turning on and off of the third transistor is determined by a second scan signal, wherein turning on and off of the fifth transistor is determined by a first sub-scan signal which is a different signal than the second scan signal.

14. The organic light emitting display as claimed in claim 13, wherein the voltage of the first compensation power source is a voltage of the data signal for displaying black.

15. The organic light emitting display as claimed in claim 13, wherein the voltage of the first compensation power source is substantially equal to the voltage of the first pixel power source.

16. The organic light emitting display as claimed in claim 13, wherein the voltage of the second compensation power source is substantially equal to the voltage of the second pixel power source.

17. The organic light emitting display as claimed in claim 13, wherein turning on and off the second transistor and the fourth transistor is determined by a first scan signal, and wherein turning on and off of the sixth transistor is determined by an emission control signal.

18. The organic light emitting display as claimed in claim 17, wherein, after the first scan signal becomes a turn-on signal, the second scan signal becomes a turn-on signal and the emission control signal becomes a turn-off signal, and wherein, after the second scan signal becomes a turn-off signal, the first scan signal becomes a turn-off signal and the emission control signal becomes a turn-on signal.

19. The organic light emitting display as claimed in claim 13, wherein pixel driving periods comprise:

a first period in which the second emission control signal and the first scan signal are in a high level and the first emission control signal is in a low level;

a second period in which the second emission control signal and the first emission control signal are in a low level and the first scan signal is in a high level;

a third period in which the first emission control signal and the first scan signal are in a high level and the second emission control signal is in a low level;

a fourth period in which the first emission control signal is in a high level and the second emission control signal and the first scan signal is in a low level;

a fifth period in which the first emission control signal and the first scan signal are in a high level and the second emission control signal is in a low level;

a sixth period in which the first emission control signal, the second emission control signal, and the first scan signal are in a high level; and a seventh period in which the first emission control signal is in a low level and the second emission control signal and the first scan signal are in a high level.

20. The organic light emitting display as claimed in claim 19, wherein the length of the fourth period varies.

21. An organic light emitting display, comprising:

a pixel unit including a plurality of pixels;

a data driver for supplying data signals to the pixels;

a power source supply unit for supplying a first pixel power source, a second pixel power source, a first compensation power source, and a second compensation power source to the pixels; and a scan driver for selectively supplying the data signals, the first pixel power source, the second pixel power source, the first compensation power source, and the second compensation power source to the pixels so that the pixel current corresponding to the data signals flows to the pixels, wherein each of the pixels comprise:

an organic light emitting diode (OLED) receiving pixel current flowing from the first pixel power source to the second pixel power source to emit light;

a first transistor, comprising:

a gate coupled to a first node;

a first electrode coupled to the first pixel power source; and a second electrode coupled to a second node, wherein the pixel current flows from the first electrode to the second electrode according to a voltage of the gate;

a second transistor for selectively supplying a data signal to a third node;

a third transistor for selectively and electrically coupling the gate of the first transistor to the second electrode of the first transistor;

a fourth transistor for selectively supplying a voltage of a second compensation power source to a fourth node;

a fifth transistor for selectively supplying a voltage of a first compensation power source to the third node;

a sixth transistor for selectively supplying the pixel current to the OLED;

a first capacitor positioned between and configured to directly connect to the second node and the fourth node; and a second capacitor positioned between the third node and the fourth node, wherein pixel driving periods comprise a first period in which a first sub-scan signal and an emission control signal are in a low level and a first scan signal and a second scan signal are in a high level.

22. The organic light emitting display as claimed in claim 21:

wherein turning on and off of the second transistor and of the fourth transistor is determined by a first scan signal, wherein turning on and off of the third transistor is determined by a second scan signal, wherein turning on and off of the fifth transistor is determined by a first sub-scan signal, wherein turning on and off of the sixth transistor is determined by an emission control signal; and wherein pixel driving periods further comprise:

a second period in which the first scan signal and the emission control signal are in a low level and the first sub-scan signal and the second scan signal are in a high level;

a third period in which the first scan signal, the second scan signal, and the emission control signal are in a low level, and the first sub-scan signal is in a high level;

a fourth period in which the first scan signal and the second scan signal are in a low level and the first sub-scan signal and the emission control signal are in a high level;

a fifth period in which, the emission control signal is in a high level, the second scan signal is in a high level, the first scan signal is in a high level, and the first sub-scan signal is in a low level; and a sixth period in which the first scan signal and the second scan signal are in a high level and the first sub-scan signal and the emission control signal are in a low level.

23. The organic light emitting display as claimed in claim 22, wherein the length of the fourth period varies.

* * * * *